US008136937B2

(12) United States Patent
Yoshida

(10) Patent No.: US 8,136,937 B2
(45) Date of Patent: Mar. 20, 2012

(54) INK-JET PRINTER

(75) Inventor: Yasunari Yoshida, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1104 days.

(21) Appl. No.: 11/890,142

(22) Filed: Aug. 3, 2007

(65) Prior Publication Data

US 2008/0030563 A1 Feb. 7, 2008

(30) Foreign Application Priority Data

Aug. 3, 2006 (JP) ..... 2006-212129

(51) Int. Cl.
*B41J 2/01* (2006.01)

(52) U.S. Cl. ..... 347/104

(58) Field of Classification Search ..... None
See application file for complete search history.

(56) References Cited

U.S. PATENT DOCUMENTS

| | | | | |
|---|---|---|---|---|
| 5,847,719 | A * | 12/1998 | Yamaguchi et al. | 346/134 |
| 2002/0085078 | A1* | 7/2002 | Tanno | 347/104 |
| 2005/0225622 | A1* | 10/2005 | Anami et al. | 347/104 |

FOREIGN PATENT DOCUMENTS

| | | |
|---|---|---|
| JP | 9020038 | 1/1997 |
| JP | 2001151394 | 6/2001 |
| JP | 2004098601 | 4/2004 |
| JP | 2004130530 | 4/2004 |

* cited by examiner

*Primary Examiner* — Matthew Luu
*Assistant Examiner* — Kendrick Liu
(74) *Attorney, Agent, or Firm* — Frommer Lawrence & Haug LLP

(57) ABSTRACT

An ink-jet printer, including: a feeding mechanism which feeds a recording medium in a feeding direction; an ink-jet head which ejects ink onto a surface of the recording medium at a recording position where the ink-jet head faces the recording medium fed by the feeding mechanism in the feeding direction; a pressing device including at least one spur and pressing the surface of the recording medium on a downstream side of the recording position in the feeding direction by bringing at least one of the at least one spur into contact with the surface of the recording medium; and a pressing-position-changing mechanism which selectively realizes one of a plurality of states which are different from each other in at least one pressing position, in the feeding direction, at which the pressing device presses the surface of the recording medium.

12 Claims, 10 Drawing Sheets

INK-JET PRINTER

CROSS REFERENCE TO RELATED APPLICATION

The present application claims priority from Japanese Patent Application No. 2006-212129, which was filed on Aug. 3, 2006, the disclosure of which is herein incorporated by reference in its entirety.

BACKGROUND OF THE INVENTION

1. Field of the Invention

The present invention relates to an inkjet printer including a head which ejects ink onto a recording medium and a feeding mechanism which feeds the recording medium through a position opposed to the head.

2. Description of the Related Art

There is conventionally known the ink-jet printer including the head which ejects the ink onto the recording medium and the feeding mechanism which feeds the recording medium through a recording position where the ink ejected from the head can be applied to the recording medium. In this kind of ink-jet printer, when the recording medium is fed through the recording position, the ink is ejected onto a surface of the recording medium from the head, thereby forming desired image on the recording medium.

In addition, in this kind of inkjet printer, in order to prevent a ripple of a sheet, i.e., what is called a cockling, after the image is formed, it is proposed to provide rowels or spurs for pressing the surface of the recording medium at a position located on a downstream side of the recording position in a direction in which the feeding mechanism feeds the recording medium.

However, when the ink ejected onto the recording medium adheres to the spurs and the ink adhering to the spurs adheres to a surface of a following recording medium fed after the recording medium, the following recording medium is stained with the ink by the spurs. To deal with this, it is proposed in J. P. A. Publication No. 2004-98601 to separate the spurs for preventing the cockling from the recording medium when forming the image on a recording medium in which the cockling is relatively less likely to occur.

SUMMARY OF THE INVENTION

Unfortunately, if the spurs for preventing the cockling are completely separated from the recording medium and thereby do not function at all, a certain degree of the cockling may occur even though the recording medium in which the cockling is relatively less likely to occur is used. Thus, the ink may be unevenly applied to the recording medium, so that quality of the recorded image may be deteriorated. Therefore, it is an object of the present invention to provide an ink-jet printer which can satisfactorily reduce a cockling and an ink stain caused by spurs.

The object indicated above may be achieved according to the present invention which provides an ink-jet printer comprising: a feeding mechanism which feeds a recording medium in a feeding direction; an ink-jet head which ejects ink onto a surface of the recording medium at a recording position where the ink-jet head faces the recording medium fed by the feeding mechanism in the feeding direction; a pressing device including at least one spur and pressing the surface of the recording medium on a downstream side of the recording position in the feeding direction by bringing at least one of the at least one spur into contact with the surface of the recording medium; and a pressing-position-changing mechanism which selectively realizes one of a plurality of states which are different from each other in at least one pressing position, in the feeding direction, at which the pressing device presses the surface of the recording medium.

In the image recording apparatus constructed as described above, there is provided the pressing device including at least one spur and pressing the surface of the recording medium on the downstream side of the recording position in the feeding direction by bringing at least one of the at least one spur into contact with the surface of the recording medium, thereby reducing the cockling of the recording medium satisfactorily. Further, in the present invention, the pressing-position-changing mechanism which selectively realizes one of a plurality of states which are different from each other in at least one pressing position, in the feeding direction, at which the pressing device presses the surface of the recording medium, according to a type of sheet, for example. Thus, if the pressing-position-changing mechanism is configured to selectively realize one of a plurality of states according to the type of sheet, the following effects can be obtained. For a sheet in which the cockling is relatively more likely to occur, the at least one of the at least one spur presses the sheet at a position near to the recording position in the feeding direction, thereby reducing the cockling. For a sheet in which the cockling is relatively less likely to occur, the at least one of the at least one spur presses the sheet at a position distant from the recording position in the feeding direction, whereby the ink stain by the at least one of the at least one spur can be reduced. Thus, in the present invention, at least one of the at least one spur for preventing the cockling is used such that a position thereof is changed for the sheet in which the cockling is relatively more likely to occur and for the sheet in which the cockling is relatively less likely to occur, thereby reducing the cockling more satisfactorily in comparison with a case in which spurs for preventing the cockling are switched between a state thereof in which the spurs are used and a state thereof in which the spurs are disused.

BRIEF DESCRIPTION OF THE DRAWINGS

The above and other objects, features, advantages, and technical and industrial significance of the present invention will be better understood by reading the following detailed description of preferred embodiments of the invention, when considered in connection with the accompanying drawings, in which.

DESCRIPTION OF THE PREFERRED EMBODIMENTS

Figure 1:
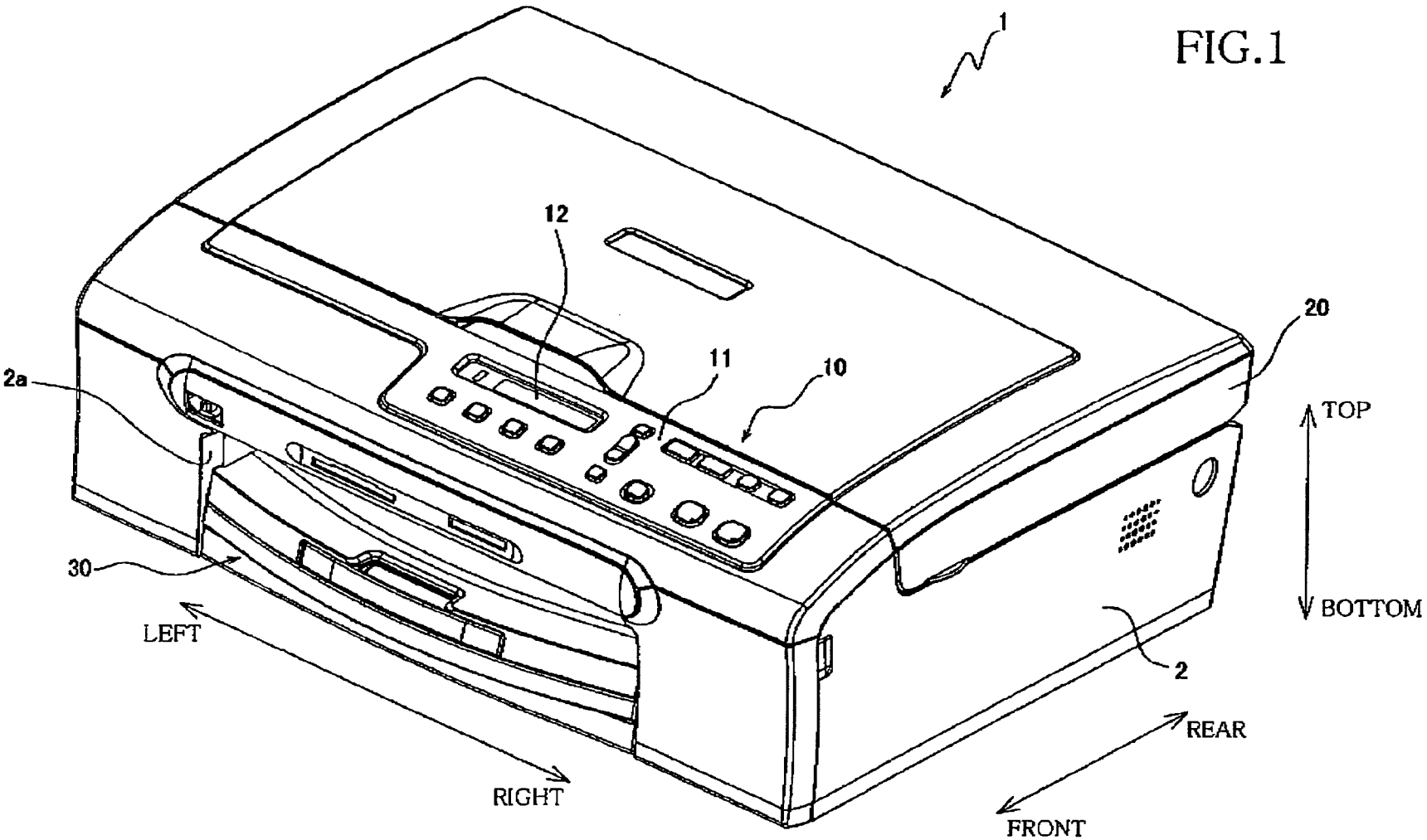
FIG. 1 is an external perspective view of an inkjet printer as an embodiment of the present invention.
Figure 2:
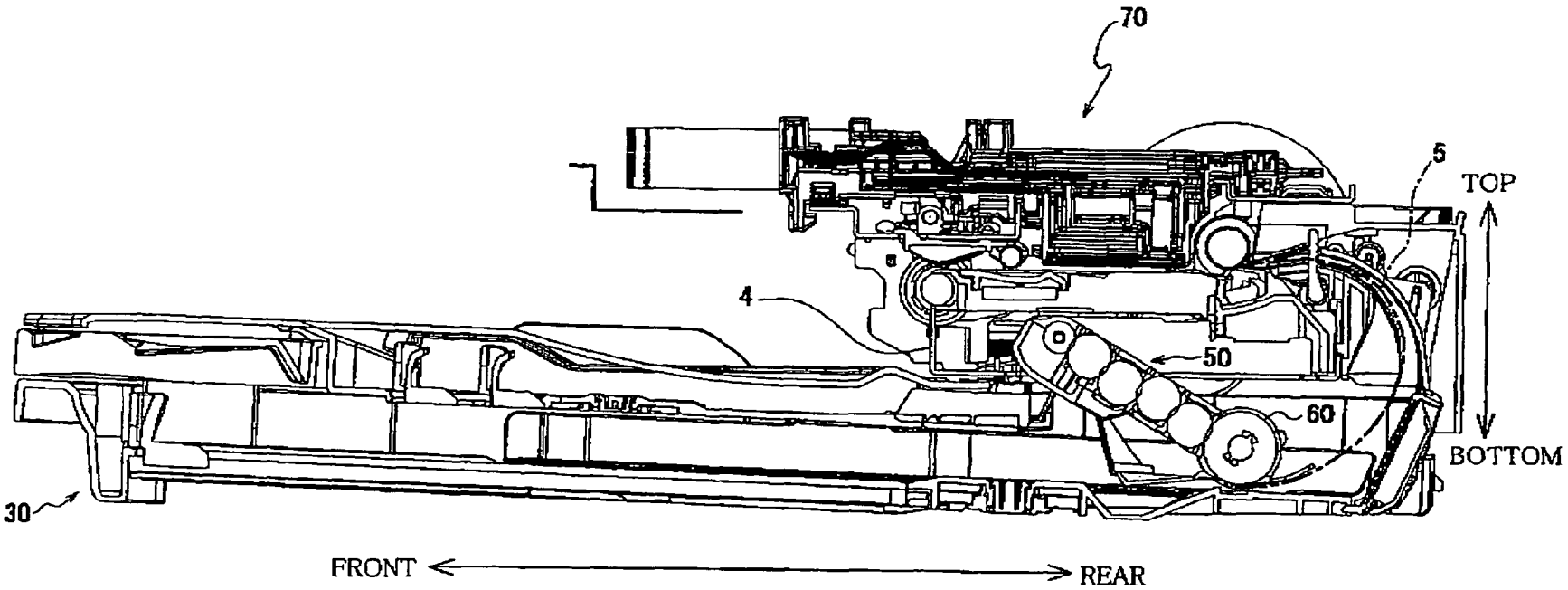
FIG. 2 is a side elevational view in cross section showing an internal structure of the ink-jet printer.

Hereinafter, there will be described preferred embodiments of the present invention by reference to the drawings. It is to be understood that the following embodiments are described only by way of example, and the invention may be otherwise embodied with various modifications without departing from the scope and spirit of the invention. FIG. 1 is an external perspective view of an ink-jet printer 1 to which the present invention is applied, and FIG. 2 is a side elevational view in cross section showing an arrangement of components accommodated in a main casing 2 of the ink-jet printer 1 but a part of the components such as a scanner unit 20 described below which are disposed in an upper portion of the ink-jet printer 1 are not shown. It is noted that, in the following description, there will be used terms "upper", "lower", "right", "left", "front", and "rear" directions of the ink-jet printer 1 that are indicated by respective arrows "TOP", "BOTTOM", "RIGHT", "LEFT", "FRONT", and "REAR" in FIG. 1 which shows a normally used state of the ink-jet printer 1. That is, an operation panel 10 described below is provided in a front portion of the ink-jet printer 1. Right and left portions of the ink-jet printer 1 are located in right and left sides, respectively, as seen from a user who is in a front side of the ink-jet printer 1.

Explanation of Overall Structure of the Ink-Jet Printer

The ink-jet printer 1 as the present embodiment is what is called a composite machine having a printing function, a scanning function, a color copying function, a facsimile function, and so on, and as shown in FIG. 1, an exterior of the ink-jet printer 1 is constituted by the main casing 2 which is formed of a synthetic resin and has a rectangular boxlike shape.

On a front portion of an upper surface of the main casing 2, there is provided the operating panel 10 which includes an operating portion 11 on which various operating buttons for an inputting operation are disposed and a display portion 12 (e.g., a crystal liquid display) on which images such as messages are displayed. Further, at a rear of the operating panel 10, the scanner unit 20 which reads an image from a document is provided. It is noted that the scanner unit 20 is used for the scanning function, the color copying function, and the facsimile function.

On the other hand, in a lower portion of an inside of the main casing 2, as shown in FIG. 2, there is provided a sheet-supply tray 30 which can accommodate a plurality of sheet-like recording media, such as paper sheets or plastic sheets, stacked (superposed) on one another, such that each of the recording media takes a substantially horizontal posture. It is noted that the sheet-supply tray 30 is detachable from the main easing 2 by being horizontally withdrawn toward the front through an opening 2*a* (as shown in FIG. 1) formed in a front surface of the main casing 2, and in contrast, the sheet-supply tray 30 is attachable to the main casing 2 by being horizontally inserted through the opening 2*a* of the main casing 2.

In a rear portion of the inside of the main casing 2 and above the sheet-supply tray 30, there is provided a frame 4 which is formed of metal and has a box-like shape elongating in the rightward and leftward direction. The sheet-supply unit 50 is supported by the frame 4 so as to be disposed above a rear end portion of the sheet-supply tray 30, and has a sheet-supply roller 60 for supplying (feeding) the recording media accommodated in the sheet-supply tray 30, one by one, to a sheet-feed path 5 provided at a rear of the sheet-supply tray 30. That is, in a rear end portion of the inside of the main casing 2, there is formed the sheet-feed path 5 through which each recording medium fed rearwardly from the sheet-supply tray 30 makes an upward U-turn and is guided frontward. Above the sheet-supply unit 50, there is disposed an image forming unit 70 which forms an image on the recording medium fed while guided by the sheet-feed path 5. The recording medium on which the image is recorded in the image forming unit 70 is discharged onto a front portion of an upper surface of the sheet-supply tray 30.

Structure of the Image Forming Unit

Figure 3A:
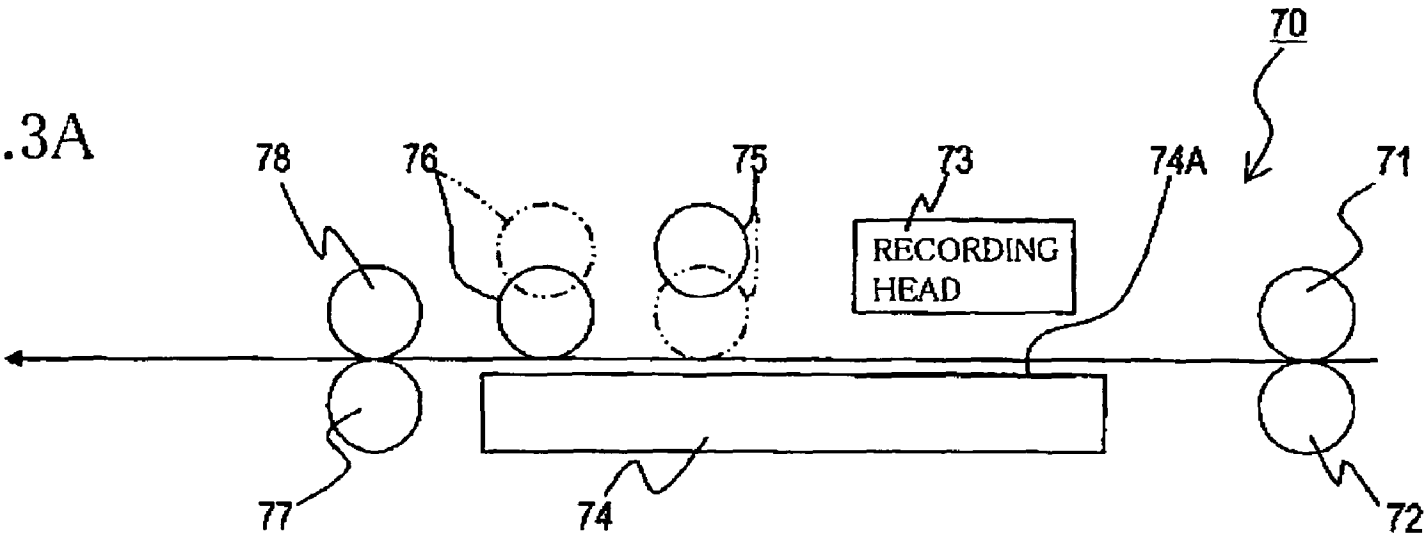
FIGS. 3A and 3B are views for explaining a structure of an image forming unit which is a part of the internal structure of the ink-jet printer.
Figure 3B:
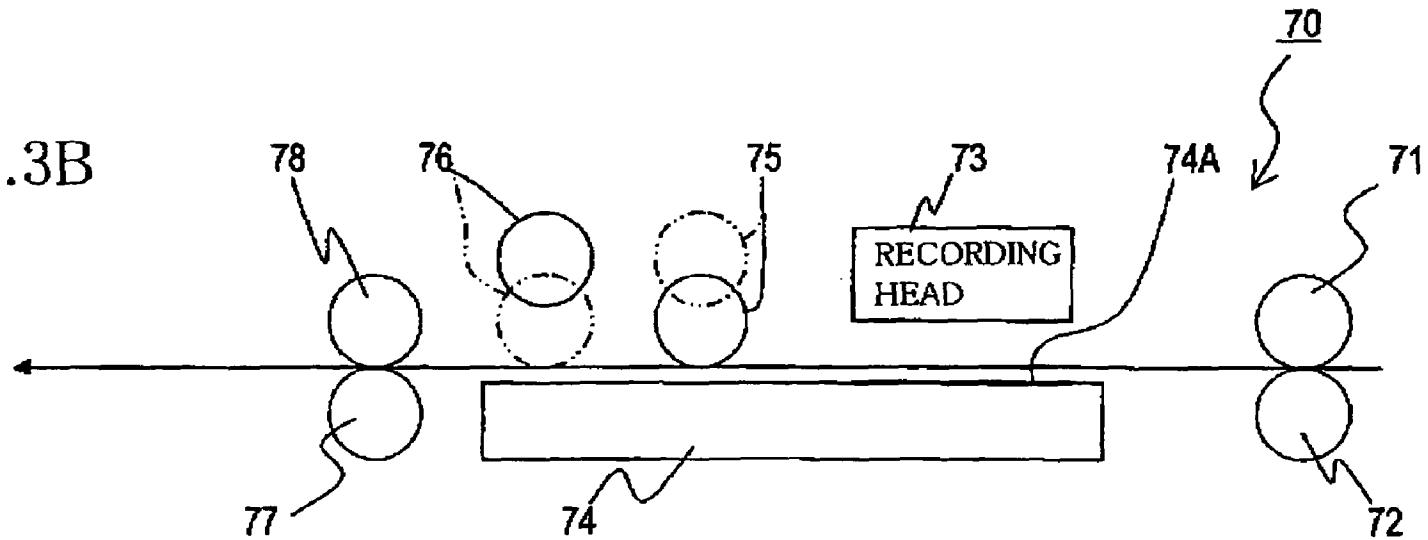
Figure 5B:
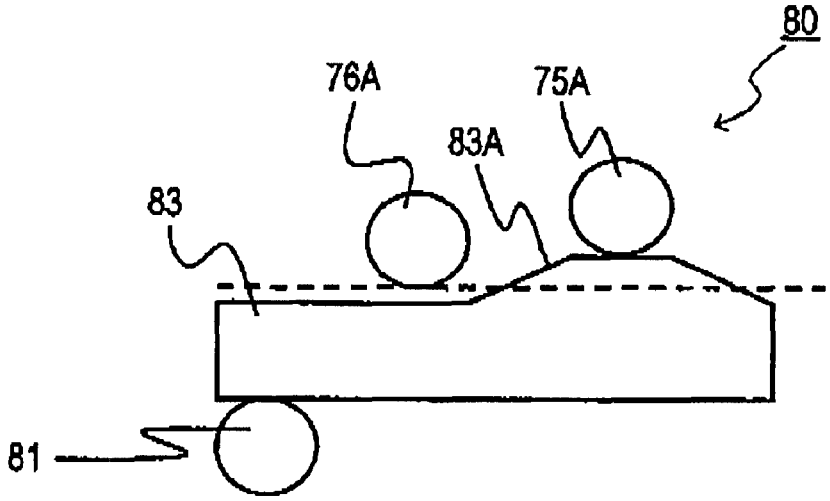
Figure 6:
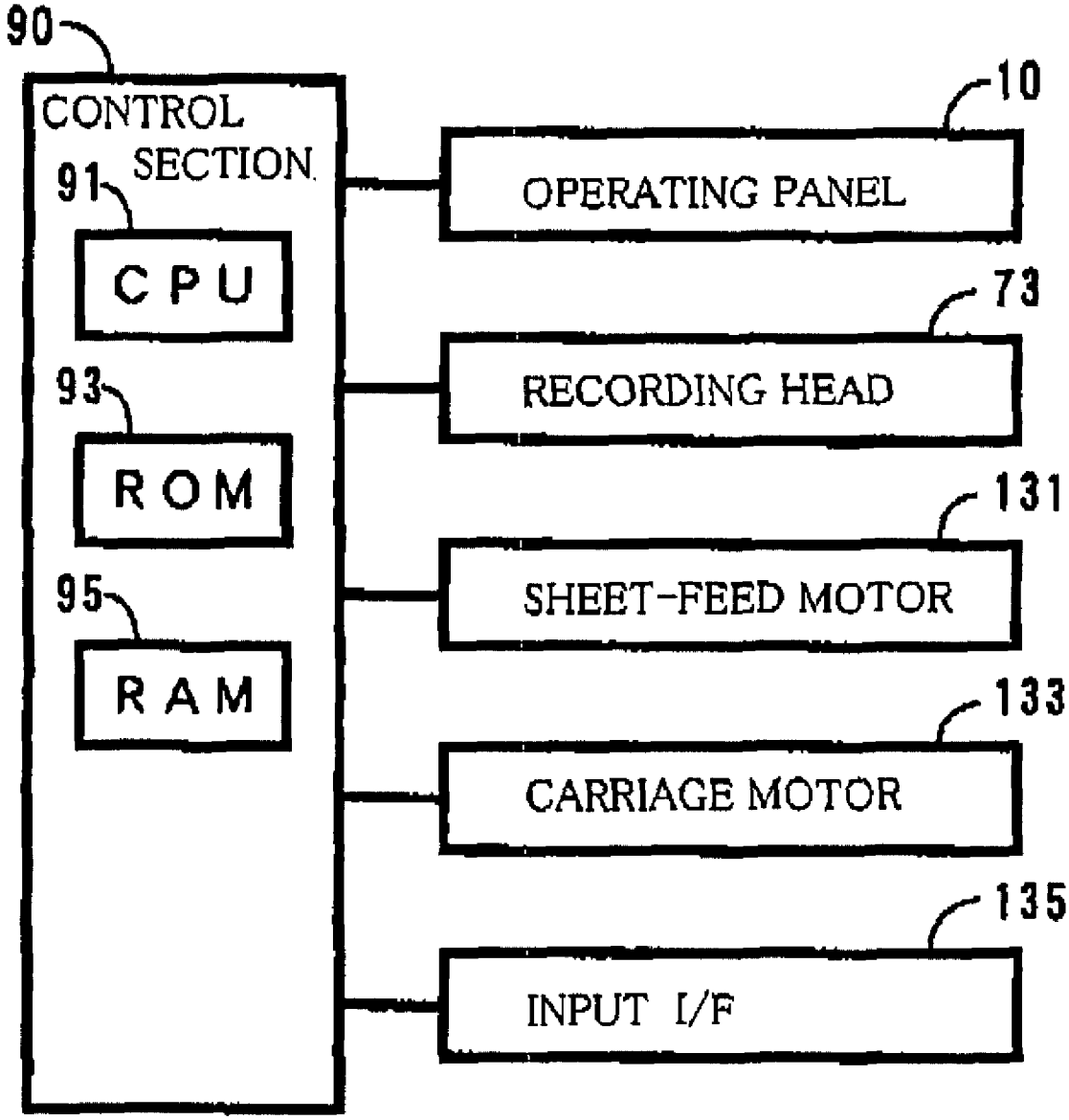
FIG. 6 is a block diagram showing a configuration of a control system of the ink-jet printer.

There will be next explained a structure of the image forming unit 70. FIGS. 3A and 5B are views for schematically explaining the structure of the image forming unit 70. As shown in FIGS. 2, 3A, and 3B, the image forming unit 70 includes a sheet-feed roller 71 provided at a position, in the sheet-feed path 5, where the recording medium fed from the sheet-supply tray 30 is reached after making the upward U-turn. The sheet-feed roller 71 is supported by side plates of the frame 4 so as to be rotatable about a rotating shaft thereof extending in the leftward and rightward direction. It is noted that the sheet-feed roller 71 is driven to be rotated by a sheet-feed motor 131 (as shown in FIG. 6). In addition, under the sheet-feed roller 71, there is provided a driven roller 72 which is rotatable about a rotating shaft thereof extending parallel to that of the sheet-feed roller 71 and driven by the same 71 to be rotated. That is, the sheet-feed roller 71 and the driven roller 72 are configured as a pair of rollers.

Further, the image forming unit 70 includes a recording head 73 which is mounted on a carriage (not shown), which is moved in the leftward and rightward direction (i.e., a main scanning direction), and which is capable of ejecting inks of a plurality of colors from nozzles formed in a lower surface of the recording head 73. In the image forming unit 70, in front of the driven roller 72, i.e., on a downstream side of the driven roller 72 in a sheet feeding direction in which the recording medium is fed, there is provided a platen 74A which supports the recording medium at a recording position where the ink ejected from the recording head 73 can be applied to the recording medium. A carriage motor 133 (as shown in FIG. 6) is driven so as to move the recording head 73, integrally with the carriage, in the main scanning direction, and the inks are ejected from the recording head 73 onto the recording medium on the platen 74A, whereby an image is formed on the recording medium.

Additionally, in front of the recording head 73, i.e., on a downstream side of the recording position in the sheet feeding direction, the image forming unit 70 includes, above a front end portion of a platen member 74, a group of spurs 75 and a group of spurs 76, for preventing a cockling, which are capable of contacting and pressing the recording medium. The platen member 74 is formed of synthetic resin and provided with the platen 74A formed on a part of an upper surface of the platen member 74. As shown in FIGS. 3A and 3B, the spurs 75, 76 are configured such that only ones of the spurs 75 and the spurs 76 are moved to a vertical position at which the ones of the spurs 75 and the spurs 76 press the recording medium (hereinafter, referred to as a "predetermined lower position"). Meanwhile, the others of the spurs 75 and the spurs 76 are placed at a vertical position which is located over the predetermined lower position and at which the others of the spurs 75 and the spurs 76 do not press the recording medium (hereinafter, referred to as a "retracted upper position"). The placements of the spurs 75, 76 in the predetermined lower position or the retracted upper position are made by a spur-moving mechanism 80 described below. Further, in front of the platen member 74, there are provided a sheet-discharge roller 77 which is driven by the sheet-feed motor 131 (as shown in FIG. 6) and a group of spurs 78, for discharging the recording medium, which are driven to be rotated by the sheet-discharge roller 77.

Figure 4:
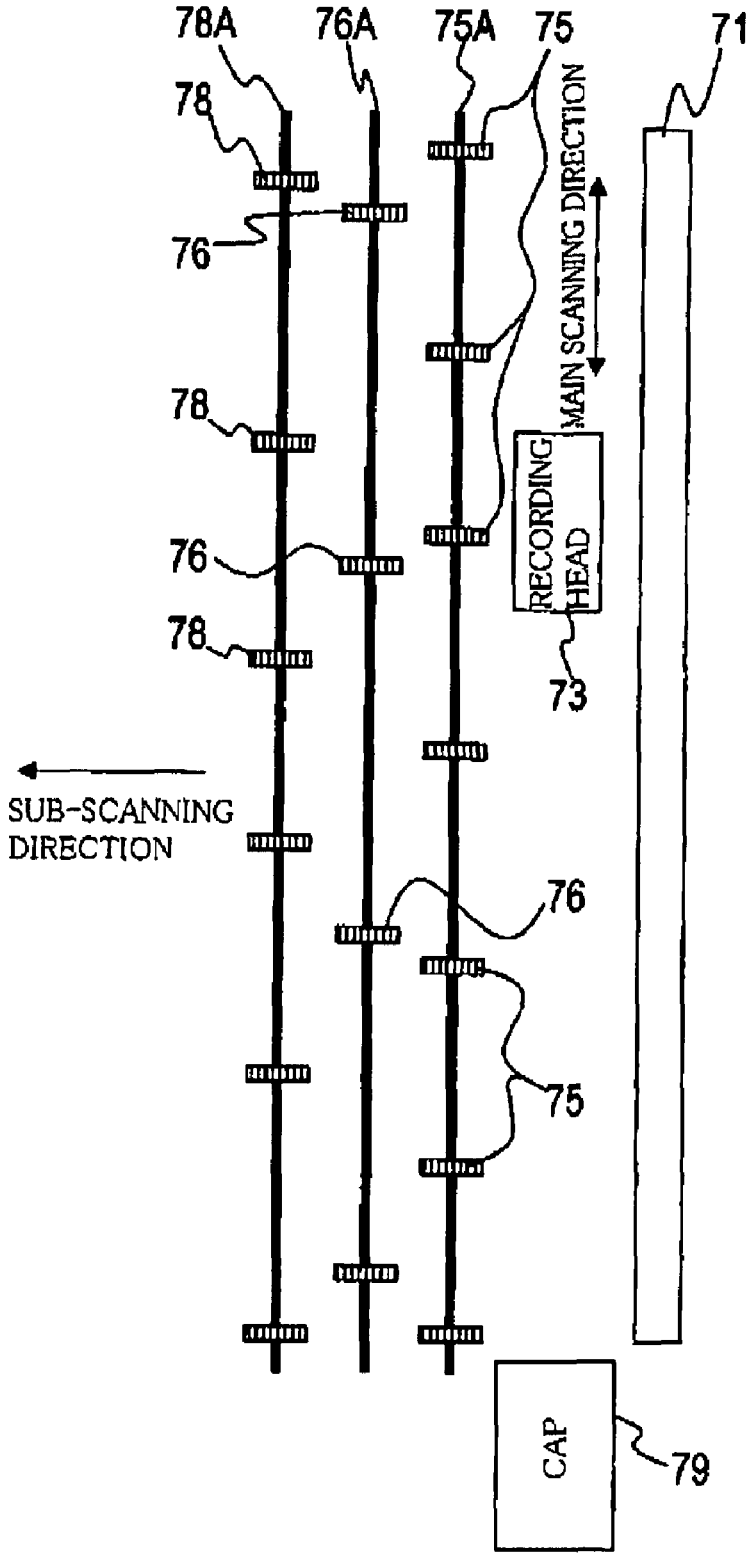
FIG. 4 is a top view schematically showing the structure of the image forming unit.

As shown in FIG. 4, the spurs 75, the spurs 76, and the spurs 78 are provided, at respective constant intervals in the leftward and rightward direction, on respective rotating shafts 75A, 76A, 78A extending in the leftward and rightward direction. Numbers of the spurs 75, the spurs 76, and the spurs 78 are different from each other, that is, seven spurs 75, six spurs 76, and four spurs 78 are provided. Further, at a right end of a range in which the recording head 73 is moved in the main scanning direction, that is, outside a sheet-feed area in which the recording medium is fed, there are provided various maintenance mechanisms such as a cap 79 which fluid-tightly closes a lower surface of the recording head 73 to suck the ink and the like from the nozzles. When the recording head 73 is located inside the sheet-feed area, as described above, a drive force of the sheet-feed motor 131 (as shown in FIG. 6) is transmitted to a driving system, including the sheet-feed roller 71 and the sheet-discharge roller 77, which is driven to feed the recording medium. When the recording head 73 is moved to a right side of the sheet-feed area, the drive force of the sheet-feed motor 131 is transmitted to the maintenance mechanisms via a clutch mechanism (not shown). Furthermore, when the recording head 73 is moved to a home position thereof located a left side of the sheet-feed area, the drive force of the sheet-feed motor 131 is transmitted to a gear 81 of the spur-moving mechanism 80 as shown in FIGS. 5A and 5B.

Figure 5A:
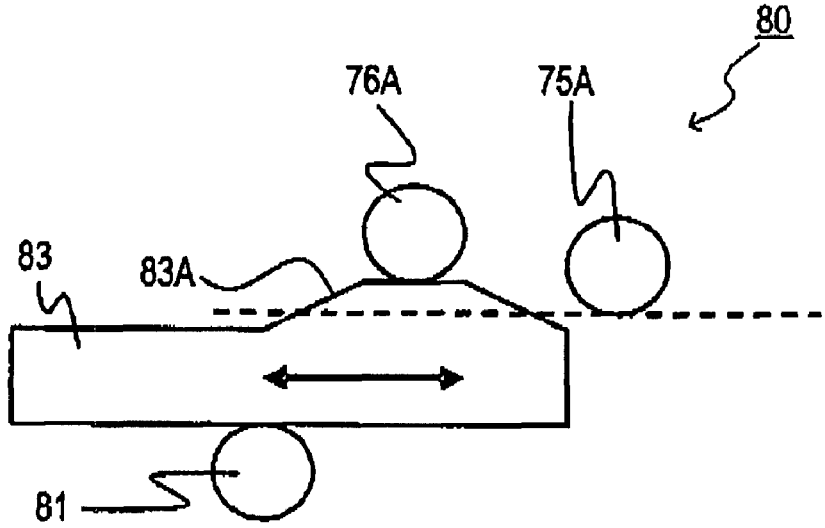
FIGS. 5A and 5B are views for explaining a structure of a spur-moving mechanism of the image forming unit.

The spur-moving mechanism 80 includes a cam 83 which is moved in the frontward and rearward direction as shown in FIGS. 5A and 513 by a rotation of the gear 81. The gear 81 serving as a pinion meshes with toothed surface of the cam 83 serving as a rack. A cam surface 83A is provided by an upper surface of the cam 83 pushes up one of rotating shafts 75A, 76A, whereby the only ones of the spurs 75 and the spurs 76 press the recording medium as described above. That is, as shown in FIG. 5A, when the cam 83 is moved frontward and the cam surface 83A pushes up the rotating shaft 76A, as shown in FIG. 3B, only the spurs 75 are moved to the predetermined lower position and press the recording medium, while the spurs 76 are moved to the retracted upper position and separated from the recording medium. In contrast, as shown in FIG. 5B, when the cam 83 is moved rearward and the cam surface 83A pushes up the rotating shaft 75A, as shown in FIG. 3A, only the spurs 76 are moved to the predetermined lower position and press the recording medium, while the spurs 75 are moved to the retracted upper position and separated from the recording medium. In addition, stoppers and the like (not shown) are further provided in mechanisms for supporting the spurs 75, 76. The rotating shafts 75A, 75B are supported by the stoppers such that the spurs 75, 76 are prevented from moving to a position lower than a position indicated by dot lines in FIGS. 3A and 3B.

In the image recording apparatus constructed as described above, it is considered that there is provided a pressing device including at least one spur and pressing the surface of the recording medium on a downstream side of the recording position in the sheet feeding direction by bringing at least one of the at least one spur into contact with the surface of the recording medium, and a pressing-position-changing mechanism which selectively realizes one of a plurality of states which are different from each other in at least one pressing position, in the sheet feeding direction, at which the pressing device presses the surface of the recording medium. More specifically, the pressing-position-changing mechanism is configured to selectively realize one of (a) a first state, as one of the plurality of states, in which the pressing device presses the surface of the recording medium at a first position and does not press the surface of the recording medium on an upstream side of the first position in the sheet feeding direction, and (b) a second state, as one of the plurality of states, in which the pressing device presses the surface of the recording medium at least at a second position located on the upstream side of the first position in the sheet feeding direction. Described in more detail, the pressing device includes a plurality of spurs as the at least one spur. The plurality of spurs includes at least one first spur capable of contacting the surface of the recording medium at the first position and at least one second spur capable of contacting the surface of the recording medium at the second position. Further, the pressing-position-changing mechanism is configured to realize (a) the first state by allowing the at least one first spur to contact the surface of the recording medium and by inhibiting the at least one second spur from contacting the surface of the recording medium, and (b) the second state by allowing at least the at least one second spur to contact the surface of the recording medium. In the above-mentioned embodiment, the spurs 76 corresponds to the at least one first spur, the spurs 75 corresponds to the at least one second spur, and the spur-moving mechanism 80 corresponds to the pressing-position-changing mechanism.

Configuration and Control of Control System of the Ink-Jet Printer

Next, as shown in FIG. 6, the ink-jet printer 1 includes a control section 90 which controls an entirety of the ink-jet printer 1. The control section 90 is connected to the operating panel 10, the recording head 73, the sheet-feed motor 131, and the carriage motor 133 as described above, and further connected to an input interface (an input I/F) 135 to which various data are inputted from a personal computer (hereinafter, referred to as a PC, not shown) as a host device. It is noted that the control section 90 is connected to not only the components described above but also various sensors, actuators, and the like, but only components relating to a following description are shown in FIG. 6.

Further, as shown in FIG. 6, the control section 90 is configured as a microcomputer including a CPU 91, a ROM 93, and a RAM 95. When a printing command is inputted to the input interface 135 from the PC, the control section 90 performs a printing operation shown in FIG. 7 on the basis of a software program stored in the ROM 93.

Figure 7:
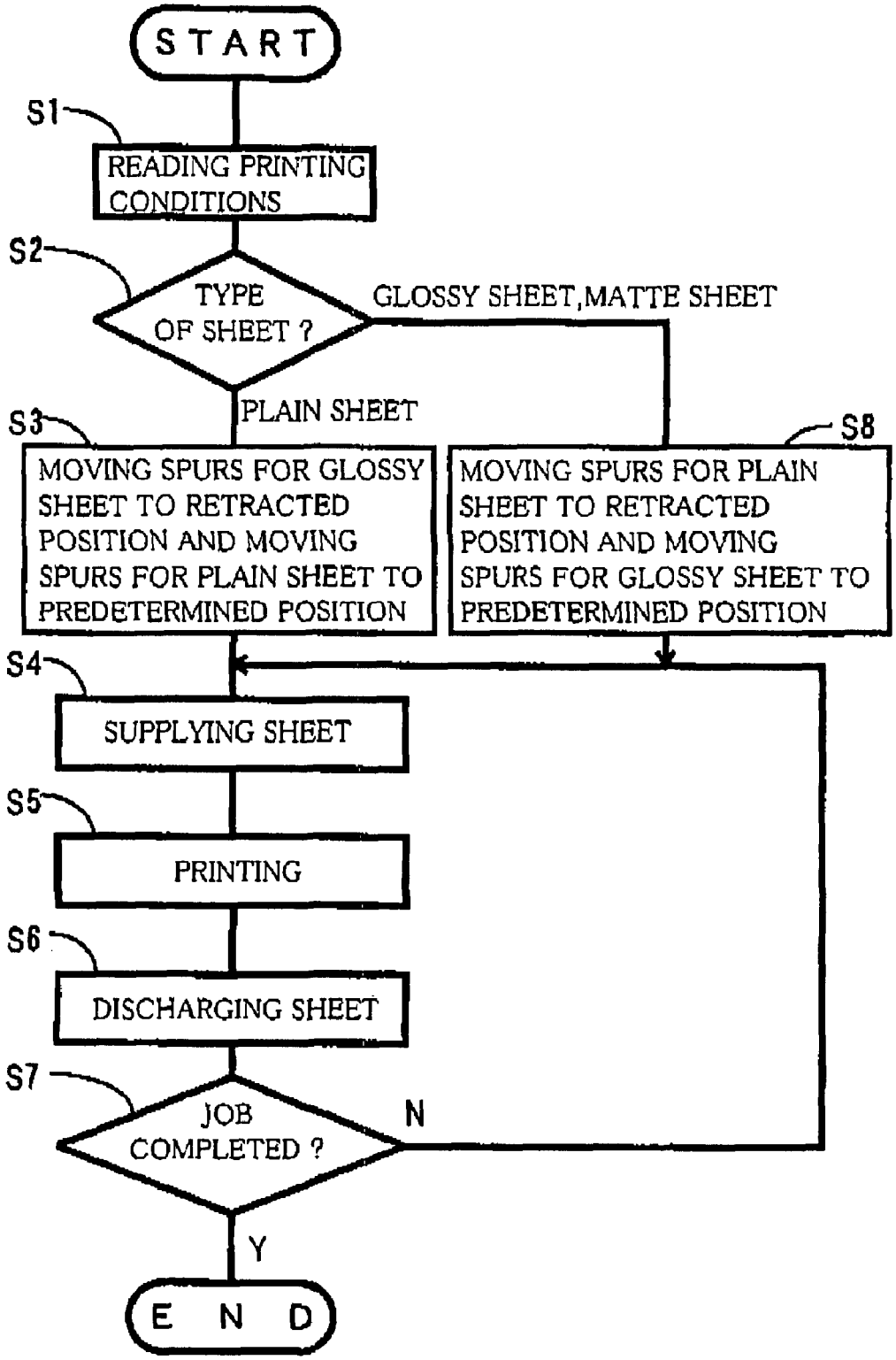
FIG. 7 is a flow chart representing a printing operation performed by the control system.

FIG. 7 is a flow chart representing the printing operation. As shown in FIG. 7, upon starting the printing operation, first in Step S1 (hereinafter, "Step" is omitted where appropriate), printing conditions set in a printer driver of the PC are read. In following S2, a type of the recording medium set in the printing conditions is judged. If it is judged, in S2, that the type of the recording medium is a plain paper sheet, the operation goes to S3 in which the spurs 75 and the spurs 76 are moved as follows. That is, because the recording head 73 is located in the home position thereof at the beginning of the operation, the sheet-feed motor 131 is driven in this state of the recording head 73, thereby rotating the gear 81. The cam 83 is thus moved by the gear 81 to a position indicated by FIG. 5A. As a result, as indicated by solid lines in FIG. 5B, the spurs 76 for a glossy paper sheet are moved to the retracted upper position, while the spurs 75 for the plain paper sheet are moved to the predetermined lower position where the spurs 75 can contact the recording medium. In other words, the spur-moving mechanism 80 is configured to realize the first state in a case where the type of the recording medium is the glossy paper sheet, and to realize the second state in a case where the type of the recording medium is the plain paper sheet.

In S4, the sheet-feed motor 131 is further driven in a state in which the recording head 73 has been moved to the sheet-feed area, whereby a process for supplying the recording medium is carried out, i.e., the recording medium is supplied by the sheet-supply roller 60 and the sheet-feed roller 71. In S5, the recording medium is further fed, and the carriage motor 133 and the recording head 73 are driven, whereby a process for printing is carried out, i.e., an image based on printing data inputted from the PC is formed on the recording medium. In S6, a process for discharging the recording medium is carried out, i.e., the recording medium is discharged by the sheet-discharge roller 77. In S7, it is judged whether a job based on the printing data is completed or not. If the job is not completed (S7: N), the steps S4-S6 are repeated. If the job is completed (S7: Y), the present printing operation is completed as well.

On the other hand, if it is judged, in S2, that the type of the recording medium is the glossy paper sheet or a matte paper sheet, the operation goes to S8 in which the spurs 75 and the spurs 76 are moved as follows, and then goes to S4 described above. That is, in S8, the sheet-feed motor 131 is driven with the recording head 73 located in the home position thereof as described above, whereby the cam 83 is moved to a position thereof indicated by FIG. 5B. As a result, as indicated by solid lines in FIG. 3A, the spurs 75 for the plain paper sheet are moved to the retracted upper position, while the spurs 76 for the glossy paper sheet are moved to the predetermined lower position where the spurs 76 can contact the recording medium. As described above, the pressing position of the pressing device including the spurs 75, 76 is changed by control of the control section 90. Thus, in this ink-jet printer 1, the above-described pressing-position-changing mechanism can be considered to be configured to include a portion of the control section 90 which controls to perform the steps S2, S3, and S8.

Effects of the Embodiment of the Present Invention

Therefore, in this ink-jet printer 1, for the plain paper sheet in which the cockling is relatively more likely to occur, the spurs 75 press the recording medium at a position near to the recording position, in the feeding direction, where the ink ejected from the recording head 73 can be applied to the recording medium, thereby reducing the cockling. For the glossy paper sheet or the matte paper sheet in which the cockling is relatively less likely to occur and which is relatively more likely to be stained with the ink by the spurs, the spurs 76 press the sheet at a position distant from the recording position in the sheet feeding direction, whereby the ink stain by the spurs can be reduced. In addition, in this ink-jet printer 1, the ones of the spurs 75 and the spurs 76 are used for preventing the cockling, thereby reducing the cockling more satisfactorily in comparison with the case in which spurs for preventing the cockling are switched between a state thereof in which the spurs are used and a state thereof in which the spurs are disused.

Further, in this ink-jet printer 1, the spurs 75 for the plain paper sheet and the spurs 76 for the glossy paper sheet are provided independently of each other, so that the following additional effects are obtained. That is, for the plain paper sheet, a pigment ink easily adhering to spurs is often used. On the other hand, for the glossy paper sheet, an image is often formed at a high resolution, so that a request preventing the ink stain by the spurs is even stronger. In addition, each of the glossy paper sheet and the matte paper sheet has a large thickness, so that the sheet is easily stained with the ink by the spurs. To deal with this, in this ink-jet printer 1, the spurs 75 for the plain paper sheet and the spurs 76 for the glossy paper sheet are provided independently of each other. Thus, the pigment ink adhering to the spurs 75 when an image is formed on the plain paper sheet with the pigment ink can be prevented from adhering to the glossy paper sheet on which an image is formed at the high resolution.

In addition, in this ink-jet printer 1, a number of the spurs 75 for the plain paper sheet is greater than that of the spurs 76 for the glossy paper sheet. Thus, for the plain paper sheet in which the cockling is more likely to occur, a relatively large number of the spurs 75 press the sheet, thereby reducing the cockling more satisfactorily. For the glossy paper sheet or the matte paper sheet in which the cockling is relatively less likely to occur and which are relatively more likely to be stained with the ink by the spurs, a relatively small number of the spurs 76 press the sheet, thereby reducing the ink stain by the spurs more satisfactorily.

It is noted that, in this inkjet printer 1, if the cam 83 is further moved frontward from a position thereof indicated by the FIG. 5A, both of the spurs 75 and the spurs 76 are moved to the predetermined lower position, whereby the both of the spurs 75 and the spurs 76 can press the recording medium. In addition, if the cam surface 83A is provided such that a portion thereof projecting upward is long enough, the both of the spurs 75 and the spurs 76 can be moved to the retracted upper position.

Modified Examples of the Embodiment of the Present Invention

Figure 8A:
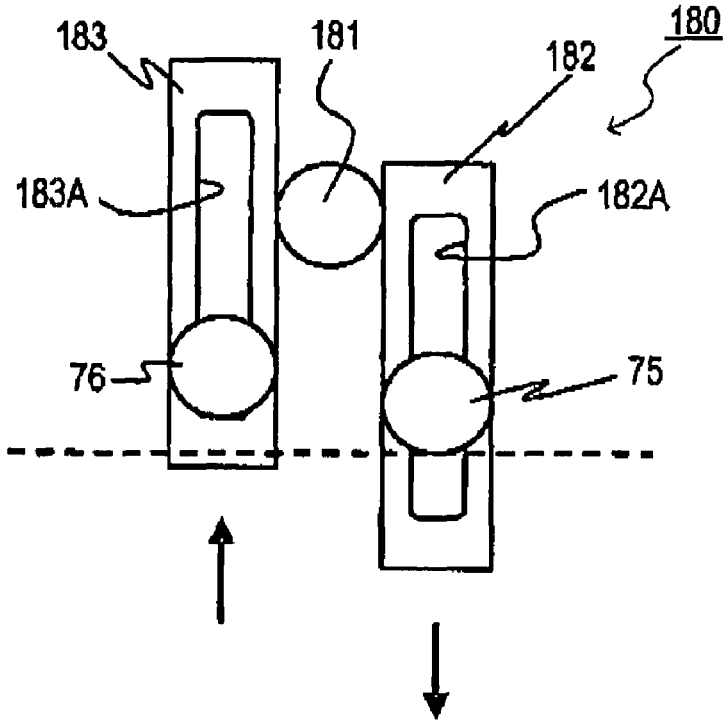
FIGS. 8A and 8B are views for explaining a structure of a modified example of the spur-moving mechanism.
Figure 8B:
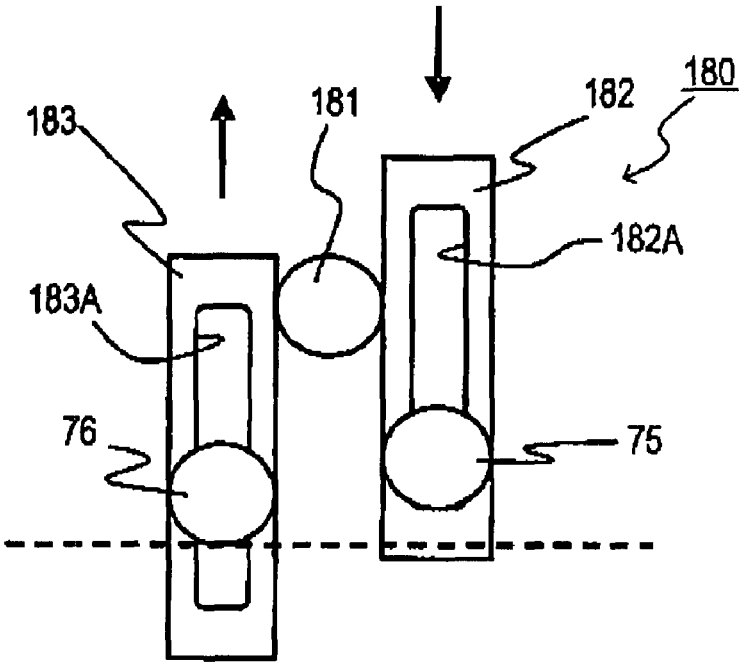

There will be next explained modified examples of the spur-moving mechanism 80 as the pressing-position-changing mechanism. In a spur-moving mechanism 180 shown in FIGS. 8A and 8B, there are provided spur holders 182, 183 sandwiching a gear 181 from the rear and the front, respectively, which gear 181 is driven as well as the gear 81. In the spur holder 182, there is formed a through hole 182A which elongates in the upward and downward direction and which is open through in the leftward and rightward direction. The rotating shaft 75A on which the spurs 75 are provided is inserted into the through hole 182A, such that the rotating shaft 75A is rotatable and movable in the upward and downward direction in the through hole 182A. Similarly, in the spur holder 183, there is formed a through hole 183A which elongates in the upward and downward direction and which is open through in the leftward and rightward direction. The rotating shaft 76A on which the spurs 76 are provided is inserted into the through hole 183A, such that the rotating shaft 76A is rotatable and movable in the upward and downward direction in the through hole 183A. It is noted that the rotating shafts 75A, 76A are downwardly biased toward respective lower ends of the through holes 182A, 183A by respective springs (not shown).

In addition, the spur holders 182, 183 and the gear 181 are engaged with each other in a state in which the spur holders 182, 183 sandwich the gear 181 from the rear and the front, respectively, as described above. The gear 181 serving as a pinion meshes with toothed surfaces of the respective spur holders 182, 183 serving as racks. Thus, when the gear 181 is rotated in a clockwise direction in FIGS. 8A and 8B, the spur holder 182 is moved downward, and the spur holder 183 is moved upward. As a result, as shown in FIG. 5B, the spurs 75 can be placed at the predetermined lower position defined by the above-described stoppers, and the spurs 76 can be placed at the retracted upper position. In contrast, when the gear 181 is rotated in a counterclockwise direction in FIGS. 8A and 8B, the spur holder 182 is moved upward, and the spur holder 183 is moved downward. As a result, as shown in FIG. 3A, the spurs 75 can be placed at the retracted upper position, and the spurs 76 can be placed at the predetermined lower position. Consequently, if the spur-moving mechanism 180 is employed, the same actions and effects as the above-described embodiment are obtained as well.

It is noted that, in this ink-jet printer 1, when each one of the spur holders 182, 183 is moved downward, the lower end of a corresponding one of the through holes 182A, 183A is placed at a position which is much lower than a position where the stoppers are located. Consequently, if the spur holders 182, 183 are placed such that height positions of the spur holders 182, 183 are approximately the same, the both of the spurs 75 and the spurs 76 are placed at the predetermined lower position, thereby pressing the recording medium.

Figure 9A:
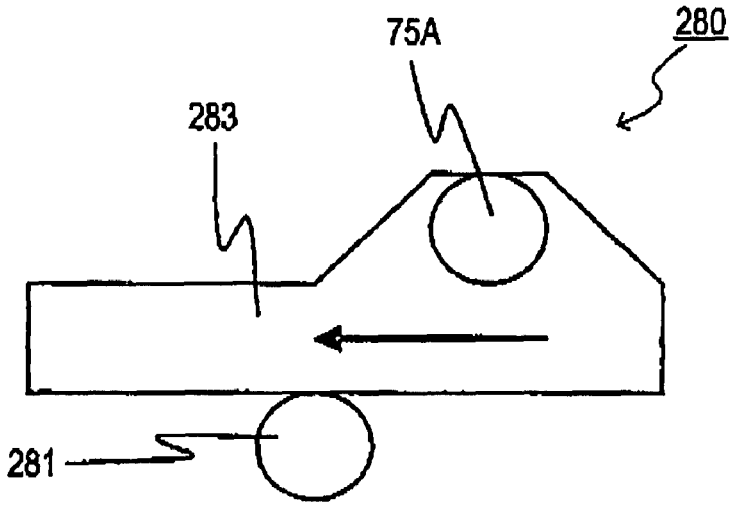
FIGS. 9A and 9B are views for explaining a structure of another modified example of the spur-moving mechanism.
Figure 9B:
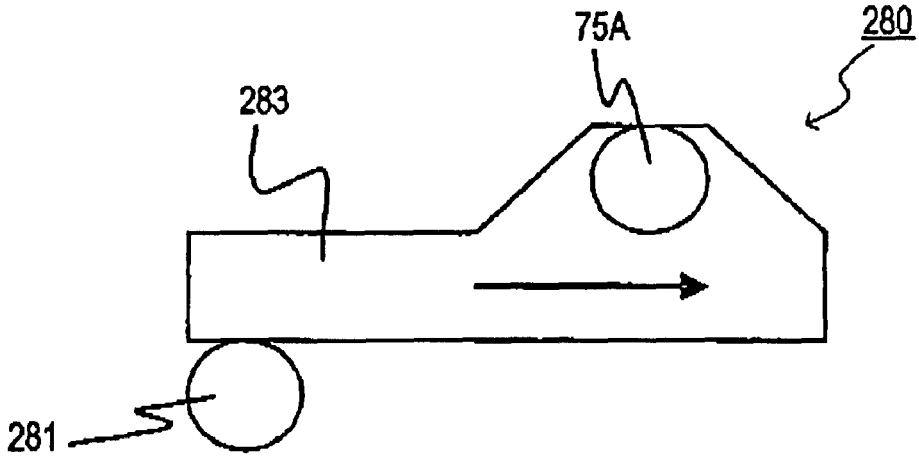

Next, a spur-moving mechanism 280 shown in FIGS. 9A and 9B includes a bearing member 283 which is moved in the frontward and rearward direction, as well as the cam 83, by a rotation of a gear 281 driven as well as the above-mentioned gear 81. The bearing member 283 supports the rotating shaft 75A such that the rotating shaft 75A is rotatable and movable integrally with the bearing member 283. In addition, in this inkjet printer 1, the spurs 76 are not provided. In the spur-moving mechanism 280 thus configured, the spurs 75 are moved in the frontward and rearward direction, thereby changing positions at which the spurs 75 press the recording medium. In other words, the spur-moving mechanism 280 is configured to realize (a) the first state by positioning the spurs 75 to positions in which the spurs 75 are allowed to contact the surface of the recording medium at the first position, and (b) the second state by positioning the spurs 75 to positions in which the spurs 75 are allowed to contact the surface of the recording medium at the second position. Thus, in this inkjet printer 1, for the plain paper sheet in which the cockling is relatively more likely to occur, the spurs 75 are placed at the position near to the recording position in the sheet feeding direction, thereby reducing the cockling. For the glossy paper sheet or the matte paper sheet in which the cockling is relatively less likely to occur and which is more likely to be stained with the ink by the spurs, the spurs 75 are placed at the position distant from the recording position in the sheet feeding direction, thereby reducing the ink stain by the spurs. In addition, if the spur-moving mechanism 280 is employed, the above-described effects obtained by providing the spurs 75 for the plain paper sheet and the spurs 76 for the glossy paper sheet independently of each other are not obtained, but fewer components of the image forming unit 70 and the spur-moving mechanism 80 can be used, thereby reducing a manufacturing cost of the ink-jet printer 1, in comparison with the above-mentioned embodiments.

In addition, the present invention is not limited to the above-described embodiments, but may be embodied with various changes and modifications without departing from the spirit and scope of the present invention. For example, the present invention may be modified as follows. That is, the cockling is more likely to occur in a thin paper sheet, and is less likely to occur in a thick paper sheet. Further, the thin paper sheet has low rigidity, and the thick paper sheet has high rigidity. Thus, a higher pressure is applied to the thick paper sheet than the thin paper sheet when the spurs contact the recording medium, so that the thick paper sheet is more likely to be stained with the ink than the thin paper sheet. To deal with this, the operation of FIG. 10 may be substituted for that of FIG. 7. It is noted that because the operation of FIG. 10 is different from that of FIG. 7 only in a way in which S102, S103, and S108 of the FIG. 10 are substituted for S2, S3, and S8 of the FIG. 7, respectively, there will be explained only these differences.

In S102 substituted for S2, it is judged that the type of the recording medium set in the printing conditions is the thick paper sheet having a thickness larger than a predetermined thickness or the thin paper sheet having a thickness smaller than the predetermined thickness. If it is judged, in S102, that the type of the recording medium is the thin paper sheet, the spurs 75 and the spurs 76 are moved as follows in S103. That is, as indicated by the solid lines in FIG. 3B, the spurs 76 for the thick paper sheet are moved to the retracted upper position, while the spurs 75 for the thin paper sheet are moved to the predetermined lower position where the spurs 75 can contact the recording medium.

In contrast, if it is judged, in S102, that the type of the recording medium is the thick paper sheet, the spurs 75 and the spurs 76 are moved as follows in S108. That is, as indicated by the solid lines in FIG. 3A, the spurs 75 for the thin paper sheet are moved to the retracted upper position, while the spurs 76 for the thick paper sheet are moved to the predetermined lower position where the spurs 76 can contact the recording medium. That is, the spur-moving mechanism 80 is configured to realize the first state in a case where the type of the recording medium is the thick paper sheet having a thickness larger than the predetermined thickness, and to realize the second state in a case where the type of the recording medium is the thin paper sheet having a thickness smaller than the predetermined thickness.

Figure 10:
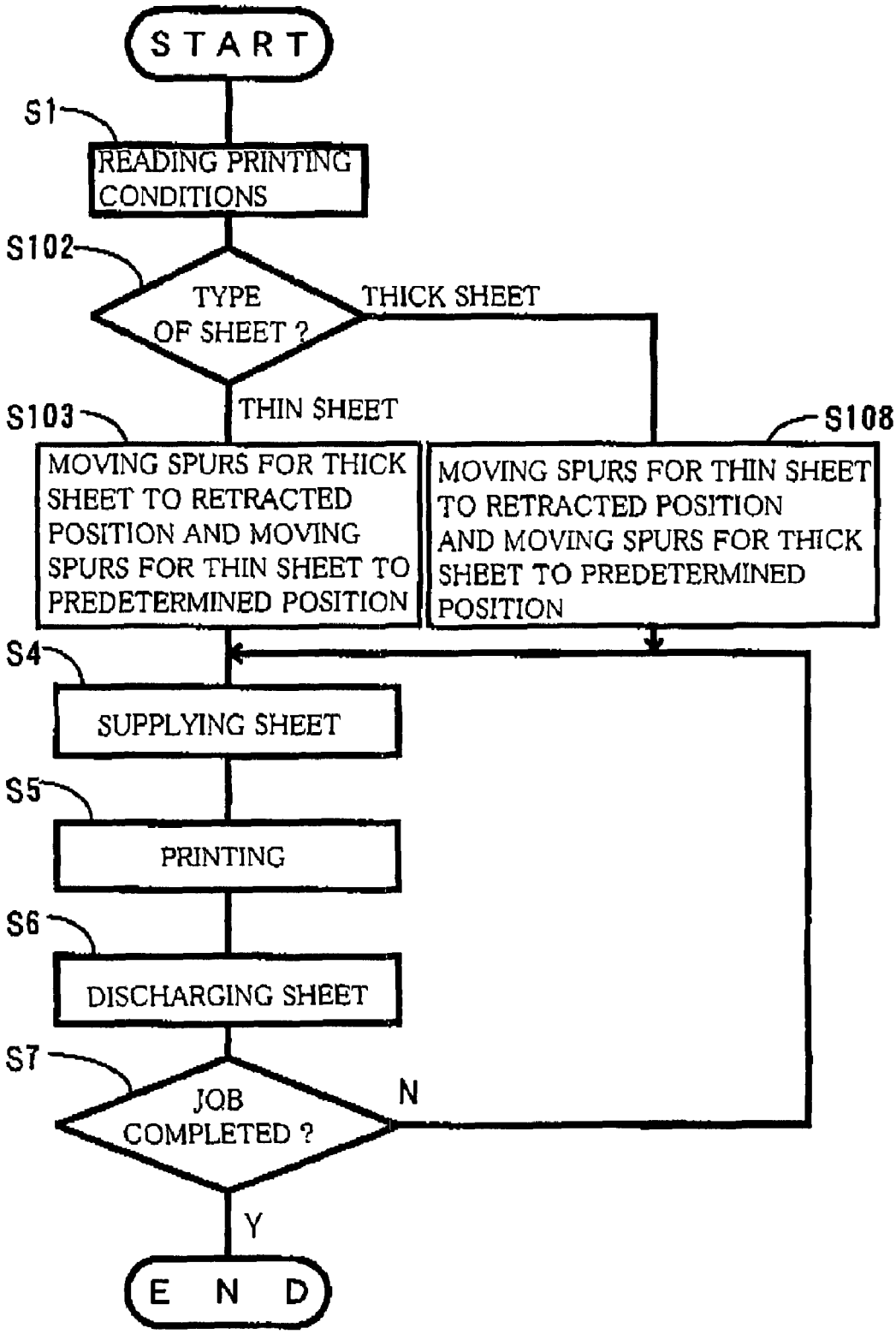
FIG. 10 is a flow chart representing a modified example of the printing operation.

In the operation of FIG. 10, for the thin paper sheet which is relatively less likely to be stained with the ink and in which the cockling are relatively more likely to occur, the spurs 75 press the recording medium at the position near to the recording position, thereby reducing the cockling. For the thick paper sheet which is relatively more likely to be stained with the ink and in which the cockling are relatively less likely to occur, the spurs 76 press the recording medium at the position distant from the recording position, thereby reducing the ink stain by the spurs. As described above, the pressing position of the pressing device including the spurs 75, 76 is changed by control of the control section 90. Thus, in this ink-jet printer 1, the above-described pressing-position-changing mechanism can be considered to be configured to include a portion of the control section 90 which controls to perform the steps S102, S103, and S108.

Further, in the above-described embodiments, the present invention is applied to what is called a serial-type printer in which the recording head 73 is moved in the main scanning direction, but may be applied as well to what is called a line-type printer in which the nozzles are aligned in the main scanning direction. In addition, a driving source of the gear 81, (181), (281) is not limited to the sheet-feed motor 131, but a motor exclusively used for the gear 81, (181), (281) may be additionally provided, for example,

What is claimed is:

1. An ink-jet printer, comprising:

a feeding mechanism which feeds a plurality of recording media one by one in a feeding direction;

an ink-jet head which ejects ink onto a surface of the recording medium at a recording position where the ink-jet head faces the recording medium fed by the feeding mechanism in the feeding direction;

a pressing device including:

a first spur and a second spur capable of pressing the surface of the recording medium respective pressing positions each located on a downstream side of the recording position in the feeding direction, the first spur being located on a downstream side of the second spur in the feeding direction; and a height changing mechanism configured to move the second spur in a vertical direction such that the second spur is positioned at either (a) a second-spur upper position at which the second spur does not contact the surface of the recording medium or (b) a second-spur lower position at which the second spur presses the surface of the recording medium; and a controller configured to control the height changing mechanism;

wherein the controller is configured to control the height changing mechanism to move the second spur to the second-spur upper position to realize a first state in which the second spur is located at the second-spur upper position, and the first spur is located below the second spur so as to press the surface of the recording medium; and wherein the controller is configured to control the height changing mechanism to move the second spur to the second-spur lower position to realize a second state in which the second spur is located at the second-spur lower position so as to press the surface of the recording medium, and the first spur is located at one of a first position at which the first spur presses the surface of the recording medium and a second position, located above the first position, at which the first spur does not contact the surface of the recording medium.

2. The ink-jet printer according to claim 1;

wherein the pressing device includes a plurality of first spurs each as the first spur and a plurality of second spurs each as the second spur, the plurality of first spurs being arranged in a row in a direction perpendicular to the feeding direction, the plurality of second spurs being arranged in a row in the direction perpendicular to the feeding direction; and wherein a number of the plurality of second spurs is greater than that of the plurality of first spurs.

3. The ink-jet printer according to claim 1;

wherein the height changing mechanism is configured to move the first spur in the vertical direction such that the first spur is positioned at either (a) a first-spur upper position at which the first spur does not contact the surface of the recording medium or (b) a first-spur lower position at which the first spur presses the surface of the recording medium;

wherein the controller is configured to control the height changing mechanism to move the first spur to the first-spur lower position and the second spur to the second-spur upper position to realize a state as the first state in which the first spur is located at the first-spur lower position, and the second spur is located at the second-spur upper position, the first-spur lower position being located below the second-spur upper position; and wherein the controller is configured to control the height changing mechanism to move the first spur to the first-spur upper position and the second spur to the second-spur lower position to realize a state as the second state in which the first spur is located at the first-spur upper position, and the second spur is located at the second-spur lower position, the second-spur lower position being located below the first-spur upper position.

4. The ink-jet printer according to claim 3;

wherein the controller includes a medium-type judging section configured to judge whether the recording medium is a glossy paper sheet or a plain paper sheet which has a lower gloss than the glossy paper sheet; and wherein the controller is configured to control, on the basis of a result of the judgment of the medium-type judging section, the height changing mechanism to realize the first state in a case where a type of the recording medium is the glossy paper sheet, and to realize the second state in a case where the type of the recording medium is the plain paper sheet.

5. The ink-jet printer according to claim 3;

wherein the height changing mechanism is configured to realize the first state in a case where a type of the recording medium is a thick paper sheet having a thickness larger than a predetermined thickness, and to realize the second state in a case where the type of the recording medium is a thin paper sheet having a thickness smaller than the predetermined thickness.

6. The ink-jet printer according to claim 3;

wherein the controller transmits a command to the height changing mechanism to selectively realize one of the first state and the second state and to continue the realized one of the first state and the second state during the feeding of each of the plurality of recording media after said each recording medium has reached the pressing position.

7. The ink-jet printer according to claim 6;

wherein the controller is configured to control the height changing mechanism to change one of the first state and the second state to the other of the first state and the second state for each of the plurality of recording media before the controller controls the ink-jet head to eject the ink onto the surface of said each recording medium.

8. The ink-jet printer according to claim 6;

wherein the height changing mechanism includes a spur-height changing member configured to change heights of the first spur and the second spur; and wherein the controller is configured to control the spur-height changing member such that the spur-height changing member is moved to move the first spur and the second spur to selectively realize one of the first state and the second state.

9. The ink-jet printer according to claim 8;

wherein the controller is configured to control the spur-height changing member to be moved in a direction perpendicular to a direction in which the first spur and the second spur are moved.

10. The ink-jet printer according to claim 9;

wherein the spur-height changing member is located below the first spur and the second spur, and wherein the controller is configured to control the spur-height changing member to be moved in the feeding direction to push up at least one of the first spur and the second spur in the vertical direction.

11. The ink-jet printer according to claim 8;

wherein the controller is configured to control the spur-height changing member to be moved in a direction in which the first spur and the second spur are moved.

12. The ink-jet printer according to claim 3;

wherein the first-spur upper position is the same as the second-spur upper position in height, and the first-spur lower position is the same as the second-spur lower position in height.

* * * * *